US005347251A

United States Patent [19]

Arrendale

[11] Patent Number: 5,347,251

[45] Date of Patent: Sep. 13, 1994

[54] GAS COOLED HIGH VOLTAGE LEADS FOR SUPERCONDUCTING COILS

[75] Inventor: Hubert G. Arrendale, Ramona, Calif.

[73] Assignee: Martin Marietta Corporation, San Diego, Calif.

[21] Appl. No.: 155,413

[22] Filed: Nov. 19, 1993

[51] Int. Cl.[5] ..... H01F 7/22

[52] U.S. Cl. ..... 335/216; 174/15.5; 62/51.1; 62/51.3

[58] Field of Search ..... 335/216; 62/51.1, 51.3; 174/15.4, 15.5; 505/879, 880, 885, 886, 892, 893; 336/DIG. 1

[56] References Cited

U.S. PATENT DOCUMENTS

| | | | |
|---|---|---|---|
| 3,273,356 | 9/1966 | Hoffman | 62/51.1 |
| 3,286,014 | 11/1966 | Williams | 62/51.1 |
| 3,349,161 | 10/1967 | Latham | 62/51.1 |
| 3,371,145 | 2/1968 | Camille | 62/51.1 |
| 3,654,377 | 4/1972 | Fleming et al. | 174/15.4 |
| 3,692,099 | 9/1972 | Nesbitt et al. | 62/51.1 |
| 3,699,333 | 10/1972 | Cohen et al. | 250/41.9 T |
| 3,904,923 | 9/1975 | Schwartz | 315/169 TV |
| 4,119,851 | 10/1978 | Castleman et al. | 250/382 |
| 4,187,387 | 2/1980 | Parmer | 174/15.4 |
| 4,238,678 | 12/1980 | Castleman et al. | 250/381 |
| 4,322,657 | 3/1982 | Veith et al. | 313/485 |
| 4,442,383 | 4/1984 | Hill | 315/349 |
| 5,101,894 | 4/1992 | Hendricks | 165/164 |

*Primary Examiner*—Leo P. Picard
*Assistant Examiner*—Raymond Barrera
*Attorney, Agent, or Firm*—John R. Duncan; Frank D. Gilliam

[57] ABSTRACT

A voltage divider for high voltage vapor cooled leads for superconducting magnet systems. Power connections to large superconducting magnets often carry potentials in the range of 5 to 10 kilovolts. These leads penetrate the cryogenic cooling vessel surrounding the superconducting magnets. In order to avoid excessive heat leak paths that would be caused by conventional electrical insulation, the leads exiting the vessel pass through tubes cooled by boiling helium. Helium gas will break down at any distance in the potential exceeds about 2 kilovolts. Such a breakdown path exists since the vapor cooled lead is at very high potential and the helium source is at ground potential. The voltage divider provides a controlled gradient of the voltage so that no portion of the helium gas sees excessive potentials. The gas at high potential is directed through a series of conductive screens in a tube insulated from each other and connected by a resistive voltage divider. A grounded conductive sleeve surrounds the tube to limit the electric field to the space between the gradient screens. Thus, the system can operate at a high overall potential, with the potential between each pair of succeeding screens kept below the gas breakdown potential.

9 Claims, 1 Drawing Sheet

GAS COOLED HIGH VOLTAGE LEADS FOR SUPERCONDUCTING COILS

BACKGROUND OF THE INVENTION

This invention relates in general to superconducting accelerator magnets and, more specifically to a method and apparatus for operating gas cooled leads for charging superconducting coils and the like at high voltage potentials.

Magnetic fields guide particles, such as protons, through beam tubes. Particles can be accelerated to speeds approaching the speed of light by accelerators made up of a number of axially arranged high field magnets, with beam tubes under high vacuum that contain the particles.

In high energy physics research, such magnets have been used to accelerate and guide particles and cause collisions between them to reveal the presence of more fundamental particles and forces. Particle accelerators are also used in medical research and treatment, where tissues are bombarded with selected particles to change or destroy selected types of tissue, such as tumors. Other applications include x-ray lithography and protein crystallography Superconductors are materials, typically metals or ceramics, that lose all resistance when cooled below a critical temperature. Many materials have superconducting capabilities, although most only superconduct at temperatures approaching 0° K. The most practical superconductors for use in superconducting magnets are those that superconduct at or above the boiling temperature of liquid helium. Nb—Ti and $Nb_3Sn$ are the most common superconducting materials. Recently, ceramic superconductors, such as $YBa_2Cu_3O_7$ have been developed that have critical temperatures above the boiling temperature of liquid nitrogen.

Magnets formed from superconductors and cooled below their critical temperatures are highly efficient and can provide extremely high magnetic fields. Such magnets are used in particle accelerators used in medical treatment, physics research, superconducting magnetic energy storage and other fields. The Superconducting Supercollider will use thousands of superconducting magnets to guide particles through a very long, multi-magnet tube.

Because of the extremely low temperatures at which the magnets operate, a complex very efficient thermal insulation system must be provided. Typically, the magnet coils may be cooled by liquid helium in a vessel surrounding the coils. A vacuum vessel surrounds the helium vessel, surrounded in turn by a liquid nitrogen shield and high efficiency multilayer film insulation.

Superconducting magnets require leads penetrating through this insulation system in order to charge and discharge the magnet coils as necessary. These leads are a source of very significant heat leaks into the system, which can cause excessive boil-off of the liquid helium and liquid nitrogen. In order to reduce this heat leak, the leads are conventionally cooled by boiling liquid helium vapor.

The vapor cooled leads must be at high voltage potentials to ground during operation of the magnet coils while at the same time the gas is being recovered by equipment at ground potential. Due to the poor insulating qualities of helium gas, the leads have typically been limited to about 500 volts to ground. With large magnet systems, the ability to use a much higher potential at these leads would permit more rapid magnet charging and discharging and over-all much more efficient operation of the magnet system.

Thus, there is a continuing need for methods and apparatus that permit operation of electrical leads and the like that penetrate through superconductor insulation at much higher potentials.

SUMMARY OF THE INVENTION

The above-noted problems, and others, are overcome by the voltage divider for superconducting magnet coil system vapor cooled leads of this invention. The electrical leads are cooled by boiling liquid gas, such as helium. The resulting vapor is directed to a cryogenic gas recovery facility at ground potential. The gas is directed through a tube containing the voltage divider to assure that no portion of the vapor sees a potential at any point along the tube in excess of the breakdown potential. The gas is reduced stepwise through the tube from the very high lead potential to ground.

The voltage divider assembly basically comprises a tube of electrically insulating material, a succession of conductive screens spaced along the tube with the screens electrically insulated from each other, a linear array of resistors connected in series with each succeeding resistor connected across each succeeding pair of the screens. The linear array of resistors is connected between the high potential at the entrance to said tube and ground potential at the tube exit.

The resistor array may be made up of a number of individual resistors or one long resistor tapped at appropriate points, as desired.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1:
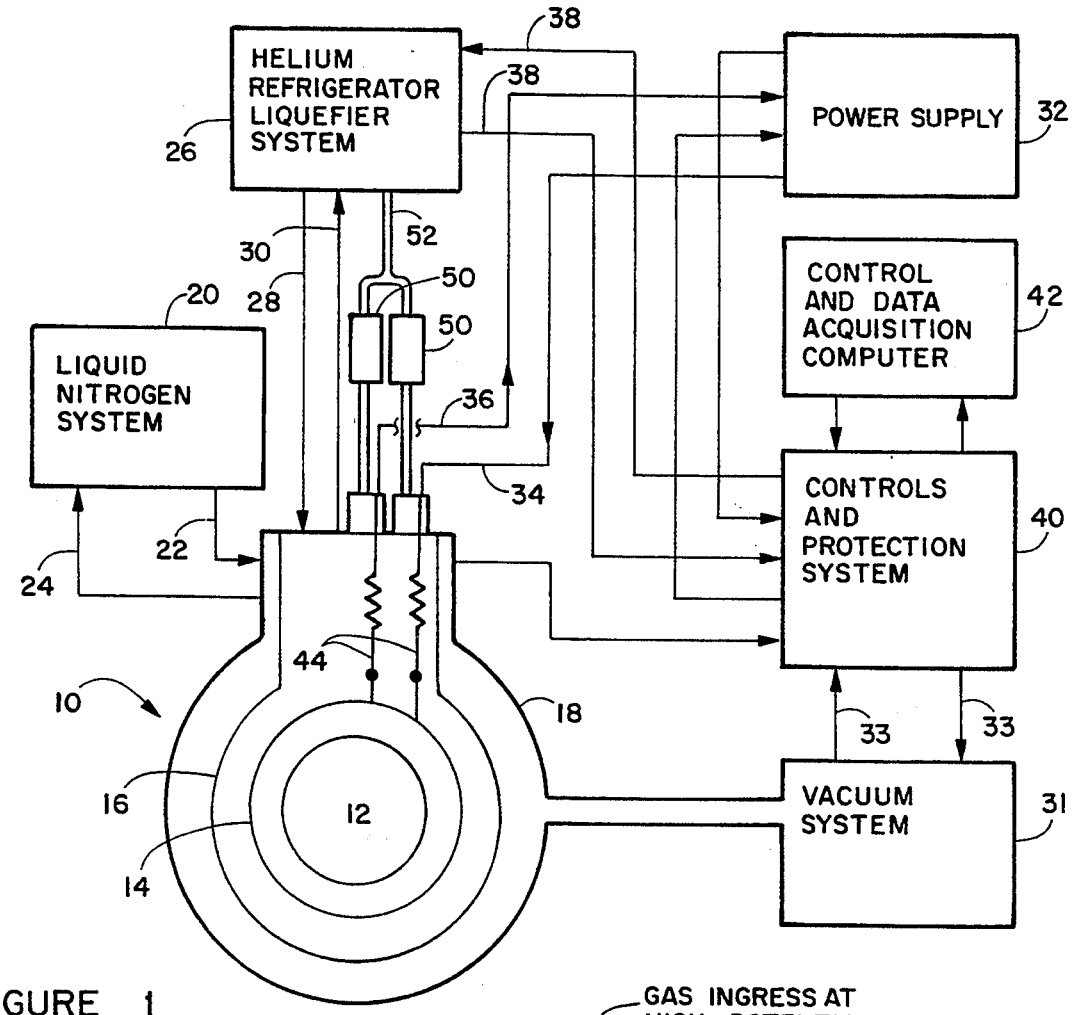
FIG. 1 is a schematic diagram of a typical magnet system using the voltage divider system of this invention.

Referring to FIG. 1, there is seen a schematic diagram of a typical over all superconducting magnet system which includes the voltage divider system of this invention.

The superconducting magnet and shield assembly 10 basically includes a superconducting magnet 12, surrounded by a liquid helium vessel 14, a liquid nitrogen vessel 16 and a vacuum shield 18. Various other components, such as supports, layers of superinsulation, etc., are omitted for clarity.

Liquid nitrogen is supplied to nitrogen vessel 16 from a liquid nitrogen supply station 20 through supply line 22. Gaseous nitrogen is returned to supply station 20 through line 24. Depending on the cost of nitrogen relative to the cost of reliquefying it, the nitrogen may be vented to the atmosphere or reliquefied at supply station 20.

Liquid helium is supplied to the helium vessel 14 from a helium refrigerator liquefier system 26. Liquid helium is furnished through line 28 with gaseous helium returned through line 30 for reliquefication.

A vacuum system 31 maintains the desired level of vacuum in vacuum shield 18.

A power supply 32 furnishes electrical power to the superconducting magnet and other system components. High current, at high voltage, is furnished to the magnet through wires 34 and 36. Operating power is supplied to the helium system 26 through wires 38 and to the vacuum system 31 through wires 33 via a control and protection system 40 which both operates all of the components and also protects the over all system in the event of a component failure or the like. Various conventional sensors (not shown) sense operating parameters and communicate with system 40, which is under the control and direction of a computer 42.

Leads 44 which carry the magnet current through the several concentric thermal insulation systems to magnet 12 pass through tubes 46 wherein they are cooled by boiling helium. The resulting helium vapor passes through lines 48 to voltage divider tubes 50, then through line 52 to helium system 26 for reliquefacation.

Figure 2:
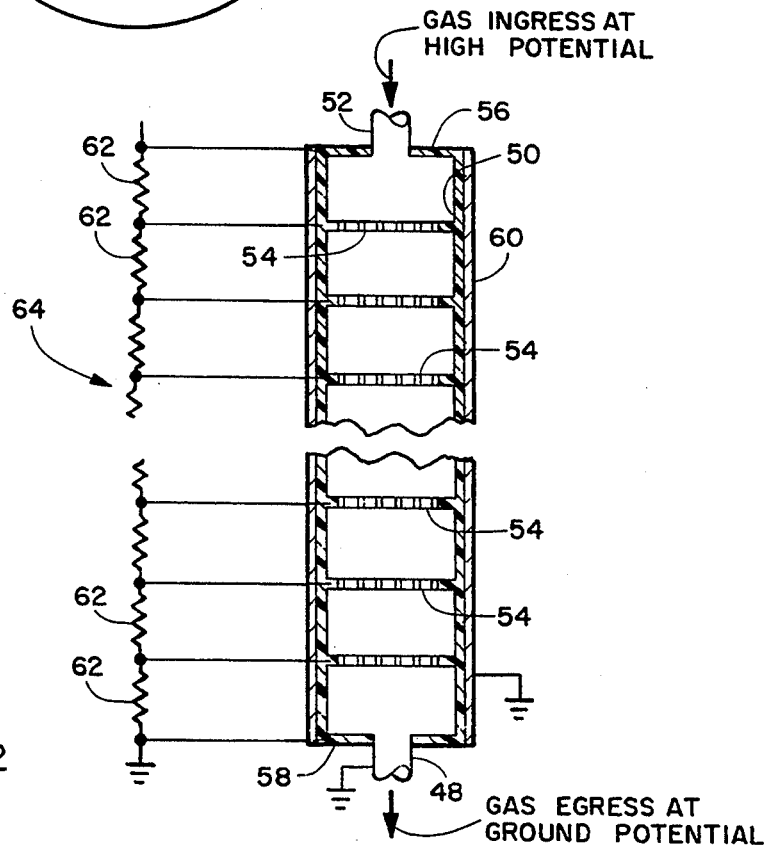
FIG. 2 is a schematic diagram of the voltage divider system itself.

Details of the voltage divider system are provided in FIG. 2. Tube 50, which is formed from an electrically insulating material such as glass or glass fiber reinforced epoxy resin composites, includes a series of conductive screens 54 spaced along the tube through which helium vapor enters at entrance end 56 and leaves at exit end 58. Screens 54 may have any suitable configuration and may be formed from any suitable material. Woven screens, perforated sheets, etc. may be used. Ideally, screens 54 provide low physical resistance to the flow of helium vapor therethrough while providing sufficient strength to stand up to the required flow rates. Typical screen materials include stainless steel, copper and aluminum.

An electrically conductive sleeve or coating 60 is placed or formed over the exterior of electrically insulating tube 50 to limit the electric field to the space between the gradient screens 54. Any suitable electrically conductive material may be used for sleeve 60. Typical materials include conductive paints and conductive epoxies.

Each resistor 62 of a linear array 64 is connected across an adjacent pair of screens 54 as shown. Resistor array 64 may be made up of individual resistors 62 connected in series as shown or a single long resistor, tapped at the appropriate points.

In a typical voltage divider having helium vapor passing through tube 50 might have a high potential at the entrance end 56 of about 900 volts. Since the Pashen minimum for helium gas is about 189 volts D.C., the field gradient between each succeeding pair of screens might be selected to be 150 volts D.C. to be assured that breakdown would not occur. Thus, 6 screens would be used, with potential drop between screens and between the last screen and the grounded exit being 150 volts. In this case, the value of each resistor 62 would preferably be about 1600 ohms.

Other applications, variations and ramifications of this invention will occur to those skilled in the art upon reading this disclosure. Those are intended to be included within the scope of this invention, as defined in the appended claims.

I claim:

1. A voltage divider system for reducing a high gas electrical potential to ground without exceeding the breakdown potential of the gas, which comprises:

a tube of electrically insulating material;

means for directing said gas at high potential into an entrance end of said tube;

a series of transverse conductive screens spaced along said tube from said entrance end to an exit end;

said screens insulated from each other;

an array of resistors connected in series, each succeeding resistor connected across each succeeding pair of said screens; and said resistor array connected between said high potential at said entrance end and ground potential at said exit end.

2. The voltage divider system according to claim 1 wherein said conducting screens are mounted in an insulating tube surrounded by a conductive sleeve.

3. The voltage divider system according to claim 1 wherein said gas is helium and the resistance between each succeeding pair of screens is from about 100 to 1000 ohms with the voltage across each adjacent pair of screens being less than about 150 volts.

4. A superconducting magnet coil charging system having vapor cooled leads, which comprises:

electrical leads for delivering direct current at high voltages to the coils of a superconducting magnet system;

means for cooling said leads with a boiling liquid gas at a high electrical potential;

a tube for receiving high potential gas at an entrance end and directing the resulting vapor to a cryogenic gas recovery facility which is at ground potential from an exit end; and a voltage divider tube for reducing the high gas electrical potential to ground without exceeding the breakdown potential of the gas;

said voltage divider tube comprising:

a series of conductive screens spaced along said tube;

said screens insulated from each other;

a series of resistors connected in series, each succeeding resistor connected across each succeeding pair of said screens; and said resistor series connected between said high potential at said entrance end and ground potential at said exit end.

5. The superconducting magnet coil charging system according to claim 4 wherein said conducting screens are mounted in an insulating tube surrounded by a conductive sleeve.

6. The superconducting magnet coil charging system according to claim 4 wherein said gas is helium and the resistance between each succeeding pair of screens is about 100 to 1000 ohms with the voltage across each adjacent pair of screens being less than about 150 volts.

7. In a superconducting magnet system in which a magnetic coil is operated at very high potential at cryogenic temperatures, said system including electrical leads for delivering direct current at high voltages to the coils of a superconducting magnet system, means for cooling said leads with a boiling liquid at a high electrical potential, and a tube for receiving high potential vapor at an entrance end and directing the resulting vapor to a cryogenic recovery facility which is at ground potential from an exit end; the improvement comprising:

a series of conductive screens spaced along said tube;

said screens insulated from each other;

a series of resistors connected in series, each succeeding resistor connected across each succeeding pair of said screens; and said resistor series connected between said high potential at said entrance end and ground potential at said exit end.

8. The improvement according to claim 7 wherein said conducting screens are mounted in an insulating tube surrounded by a conductive sleeve.

9. The improvement according to claim 7 wherein said gas is helium and the resistance between each succeeding pair of screens is about 100 to 10,000 ohms with the voltage across each adjacent pair of screens being less than about 150 volts.

* * * * *